US006086684A

United States Patent [19]

Saito et al.

[11] Patent Number: 6,086,684

[45] Date of Patent: Jul. 11, 2000

[54] ELECTRIC DISCHARGE SURFACE TREATING METHOD AND APPARATUS

[75] Inventors: Nagao Saito, 12-12, Iwanaridai 9-chome, Kasugai-shi, Aichi 487-0033; Naotake Mohri, 661-51, Yagoto-ishizaka Tenpaku-ku, Nagoya-shi, Aichi 468-0076; Yoshiki Tsunekawa, Okazaki; Kohei Shimamoto, Nagoya; Akihiro Goto, Tokyo; Takuji Magara, Tokyo; Yoshihito Imai, Tokyo; Hidetaka Miyake, Tokyo, all of Japan

[73] Assignees: Japan Science and Technology Corporation, Saitama; Nagao Saito; Naotake Mohri, both of Aichi; Mitsubishi Denki Kabushiki Kaisha, Tokyo, all of Japan

[21] Appl. No.: 09/088,658

[22] Filed: Jun. 2, 1998

[30] Foreign Application Priority Data

Jun. 4, 1997 [JP] Japan ..... 9-146893
Jun. 10, 1997 [JP] Japan ..... 9-151968

[51] Int. Cl.[7] ..... C23C 4/10; C23C 4/00; C23C 8/24; C23C 8/26

[52] U.S. Cl. ..... 148/220; 148/537; 148/238; 427/580; 427/530

[58] Field of Search ..... 148/220, 516, 148/518, 537, 230, 231, 238; 427/580, 530

[56] References Cited

FOREIGN PATENT DOCUMENTS

| | | | |
|---|---|---|---|
| 0248431 | 12/1987 | European Pat. Off. | 148/220 |
| 52-78722 | 7/1977 | Japan . | |
| 130270 | 6/1987 | Japan | 148/220 |
| 1-177357 | 7/1989 | Japan | 148/220 |
| 6-182626 | 7/1994 | Japan . | |

*Primary Examiner*—Deborah Yee
*Attorney, Agent, or Firm*—Sughrue, Mion, Zinn, Macpeak & Seas, PLLC

[57] ABSTRACT

A surface treating is performed by an electric discharge. The electric discharge is generated by applying a voltage between an electrode and a metal workpiece. The electrode is a solid or green compact electrode or the like which is made of a reforming material. The workpiece may be an end mill or the like. Then, a coating layer is formed on a surface of the metal workpiece. Thereafter, a nitriding treatment is performed on the coating layer in a nitriding vessel or the like. Thus, a hard coating layer of better quality is formed on the surface of the workpiece whether a material of the workpiece is steel or hard metal.

20 Claims, 11 Drawing Sheets

Before Polishing (Base Metal : Hard Metal)

After Polishing (Base Metal : Hard Metal)

Before Polishing (Base Metal : Steel)

After Polishing (Base Metal : Steel)

FIG.11a
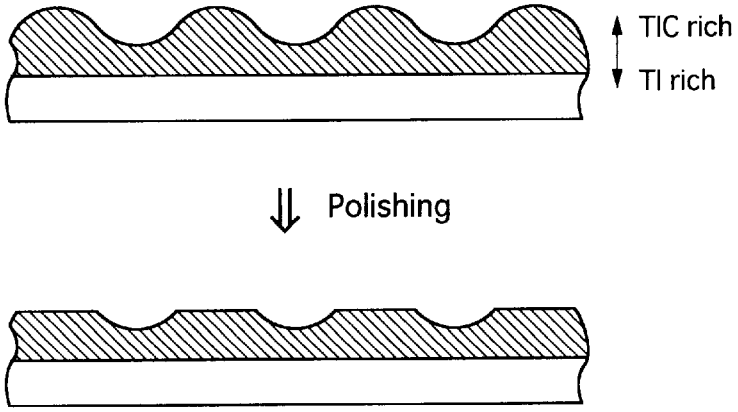
FIG.11b
FIG.12
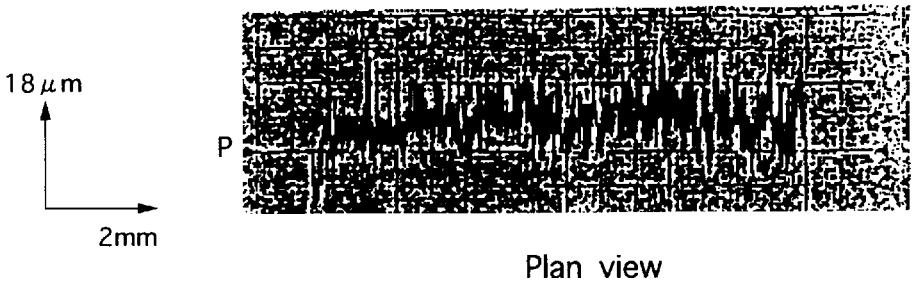

ELECTRIC DISCHARGE SURFACE TREATING METHOD AND APPARATUS

BACKGROUND OF THE INVENTION

1. Field of the Invention

This invention relates to a surface treatment of a metal material by an electric discharge. For example, it relates to an electric discharge surface treating method and apparatus for forming a coating layer on a workpiece metal surface by generating the electric discharge between an electrode and the workpiece. The electrode may be made of a reforming material or its raw material. Otherwise, the electrode is formed of a commonly used material. This invention is applicable to a surface treatment of a tool or metal mold as well as a surface treatment of an object which needs a corrosion resistance and a wear resistance such as a machine structure and machine parts. Moreover, this invention is also relates to a surface treatment for providing a finished surface roughness of high quality as well as a surface coating with a high wear resistance on a surface of a steel material or a hard metal. The hard metal may be a sintered metal of tungsten carbide-cobalt.

2. Description of the Related Art

It is conventional to give a corrosion resistance and wear resistance by forming a coating on a surface of a metal material by an electric discharge in a working fluid.

For example, an electric discharge is generated in a working fluid between a workpiece and an electrode which is formed by mixing and compressing powders of WC (tungsten carbide) and Co (cobalt) as an electrode material. The electrode material is deposited on the workpiece to define a coating layer. Then, a remelting electric discharge machining (EDM) is performed by another electrode such as Cu (copper) electrode or Gr (graphite) electrode. Thus, it is possible to give the coating layer higher hardness and adhesion.

Moreover, nitriding is known to heighten strength of a steel or the like.

For example, a workpiece such as a forging die is processed by nitriding after cut by a tool or shaped by an electric discharge. Before the nitriding, a treated surface of the workpiece is polished, because nitrogen is hard to go into the electrically discharged surface as such. Therefore, if the workpiece undergoes a heat treatment such as quench hardening or the like after the nitriding, a hardened structure does not easily return to its previous state by a high temperature of such heating operation.

Next, a conventional art will be described in detail referring to FIGS. 15*a*–15*c*.

FIG. 15*a* is an explanatory drawing showing a first processing in a conventional electric discharge surface treating method. FIG. 15*b* is an explanatory drawing showing a second processing in the conventional electric discharge surface treating method. FIG. 15*c* is a block diagram showing the conventional electric discharge surface treating method.

In the first processing, a workpiece of a base metal S50C is machined by electric discharge in a working fluid by use of a green compact electrode mixed with WC—Co, so that WC—Co is deposited on the workpiece. In the second processing, a surface of the workpiece is remelted by an electrode such as a Cu electrode which is hard to wear. When WC—Co is deposited on the workpiece in the first processing, the hardness of the coating layer structure is about Hv=1410 and many voids are remained thereat.

However, when remelting WC—Co layer in the second processing, the voids of the coating layer disappear and the hardness is heightened up to Hv=1750.

Such surface treating method can provide a steel material with a coating layer which has a high hardness and good adhesion. However, it is difficult to form such a coating layer of good adhesion on a surface of a sintered material such as a hard metal.

As mentioned above, there are some kinds of workpiece which is hard to get a coating layer of high quality by a conventional ED (electric discharge) surface treating method.

The inventors of the present application made an experiment as follows. An EDM was conducted in oil by using an electrode made by compacting a metal hydride such as TiH2 (titanium hydride). Then, the oil was decomposed to produce carbon by high temperature in the electric discharge, thereby composing TiC (titanium carbide). Moreover, TiH2 was decomposed to produce hydrogen. Such hydrogen cleaned a coating surface. As a result, it was confirmed that a surface coating layer of high strength and good adhesion could be formed thereon. It was also confirmed that, in case of using TiH2, the coating layer was constructed of carbonized TiC and non-carbonized Ti or their intermediate product. In case of using VH or the like instead of TiH2, the same result was obtained, too. If V (vanadium), VC or the like was added to TiH2, the coating layer could be given much higher hardness. In this way, if the EDM is performed in oil by the electrode of compacted metal hydride, the coating layer has high hardness and shows high wear resistance in most cases (in normal abrasion tests or the like).

However, a cutting tool edge or a cold forging die is applied with a high pressure from a metal workpiece material and sometimes heated thereby. Then, an affinity is generated between the workpiece and a coating layer surface by the electric discharge, i.e. a surface of the cutting tool edge and the like. Thus, an abrasion amount is increased, so that the life of the cutting tool or the die cannot be as long as expected from the high hardness and high wear resistance.

In case of an electric discharge surface treating using a green compact electrode, a finished surface roughness of a workpiece becomes large if it is desired to heighten a surface treating rate. At present, the best finished surface roughness is about 6 $\mu$mRz for a hard metal workpiece and about 9 $\mu$mRz for a steel workpiece, on condition that the surface treating rate is relatively high. A finished surface roughness of each of the workpieces is about 1 $\mu$mRz or less before the surface treating. Thus, the surface roughness is deteriorated and enlarged by the electric discharge surface treatment.

This is because the green compact electrode is worn during the electric discharge surface treating, thereby producing irregularity thereon. Moreover, material grains of the green compact electrode such as titanium hydride (TiH2) are hard to be broken into fine powders. Fine powdering may cause ignition and explosion or the like when pulverized. Furthermore, the electric discharge may partially concentrate due to uneven electric resistance of the green compact electrode.

In the electric discharge surface treatment, melted coating material of high temperature hits and collides with the workpiece to be scattered thereon. Thus, the ED surface treatment is advantageous compared with the PVD (physical vapor deposition), CVD (chemical vapor deposition), plating or the like, in view of its very strong adhesion. However, as mentioned above, it is hard to get a finished surface roughness up to 1 $\mu$mRz by the ED surface treatment.

The EDM can be used for a surface treatment of common wear resisting parts. However, it is not suitable for a surface treatment of a workpiece which needs a very fine finished surface roughness of about 1 μmRz. For example, the EDM is not preferred for cutting tools, cold forging dies, metal molds, or mechanical parts used in a severe condition such as bearings, construction and building machines and ship's parts.

BRIEF SUMMARY OF THE INVENTION

It is a first object of the present invention to provide a electric discharge surface treating method and apparatus that is able to form a coating layer of high quality whether a workpiece material is steel or sintered hard alloy.

It is a second object of the present invention to provide a electric discharge surface treating method and apparatus that is able to form a coating layer which can lessen affinity generated between an iron like a steel and a workpiece.

It is a third object of the present invention to provide a electric discharge surface treating method that is able to provide a fine finished surface roughness.

According to a first aspect of the invention, there is provided an electric discharge surface treating method. In the method, a coating layer is formed on a surface of a metal workpiece by applying a voltage to generate an electric discharge between the metal workpiece and an electrode, the electrode being made of a material containing a reforming material. Then, nitriding is performed on the coating layer.

According to a second aspect of the invention, there is provided an electric discharge surface treating apparatus. The apparatus comprises an electrode made of a material containing a reforming material; means for forming a coating layer on a surface of a metal workpiece by applying a voltage to generate a pulsed electric discharge between the metal workpiece and the electrode; and means for nitriding the coating layer.

According to a third aspect of the invention, there is provided an electric discharge surface treating method. In the method, a coating layer is formed on a surface of a metal workpiece by applying a voltage to generate an electric discharge between the metal workpiece and an electrode. The coating layer includes at least one of ceramics and a metal. Then, nitriding is performed on the coating layer.

According to a fourth aspect of the invention, there is provided an electric discharge surface treating apparatus. The apparatus comprises an electrode; means for forming a coating layer on a surface of a metal workpiece by applying a voltage to generate an electric discharge between the metal workpiece and the electrode, the coating layer including at least one of ceramics and a metal; and a nitriding vessel for nitriding the coating layer.

According to a third aspect of the invention, there is provided an electric discharge surface treating method. In the method, a surface of a workpiece is treated by an electric discharge using an electrode made by pressure forming of metal powders which are carbonized to harden. The surface treatment is performed in a working fluid decomposed into carbon by the electric discharge. Then, the surface of the workpiece is ground. Thereafter, nitriding is performed on the workpiece.

Further objects and advantages of the invention will be apparent from the following description, reference being had to the accompanying drawings, wherein preferred embodiments of the invention are clearly shown.

BRIEF DESCRIPTION OF THE SEVERAL VIEWS OF THE DRAWINGS

FIG. 11*a* is a conceptual drawing showing a structure of a workpiece surface which was processed by the electric discharge surface treatment of the fourth embodiment.

FIG. 11*b* is a conceptual drawing showing a structure of a workpiece surface which was processed by the electric discharge surface treatment of the fourth embodiment, polished and went through a nitriding thereafter.

FIG. 12 is a drawing showing a cross-section profile of a workpiece which was provided with a thick surface coating layer in a surface treatment according to a fifth embodiment of the invention.

DETAILED DESCRIPTION OF THE INVENTION

Figure 1:
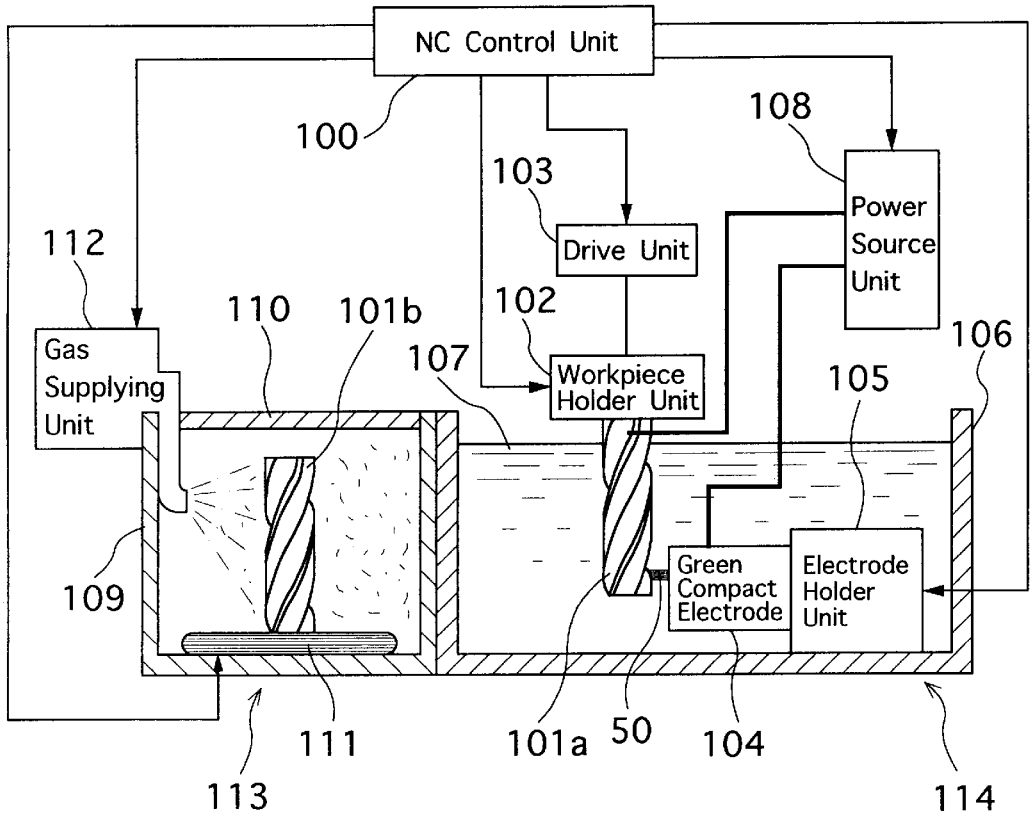
FIG. 1 is a schematic view showing an electric discharge surface treating apparatus according to a first embodiment of the invention.

Several preferred embodiments of this invention will be described hereafter referring to the attached drawings. In the drawings, the same reference characters and numerals indicate the same or corresponding elements which are commonly used in the embodiments, and their description is omitted to avoid redundancy.

As mentioned in the description of the related art, WC—Co can be deposited on a metal material as a workpiece by an electric discharge, which is generated between the workpiece and the green compact electrode of WC—Co. Then, WC—Co film can be formed on the metal material by remelting the deposited WC—Co layer by the Cu electrode.

Figure 15A:
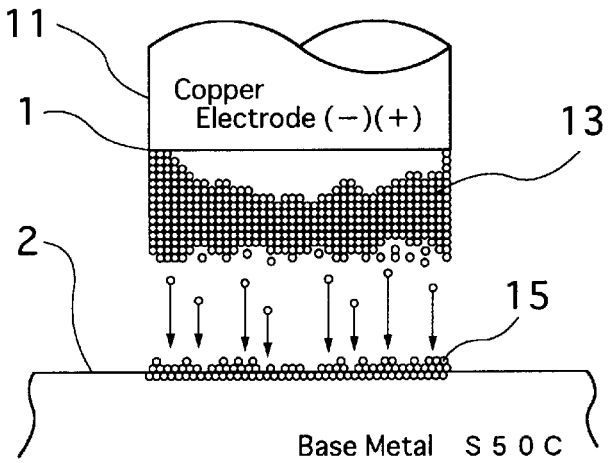
FIG. 15*a* is an explanatory drawing showing a first processing in a conventional electric discharge surface treating method.
Figure 15B:
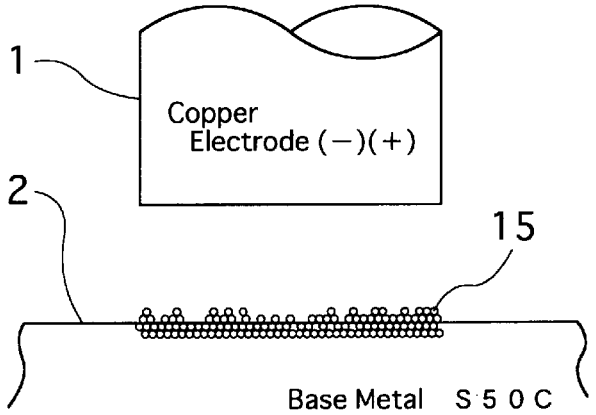
FIG. 15*b* is an explanatory drawing showing a second processing in the conventional electric discharge surface treating method.
Figure 15C:
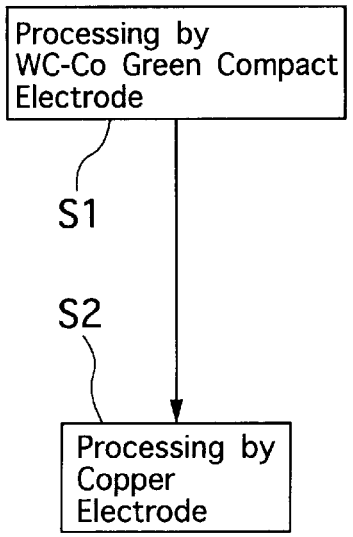
FIG. 15*c* is a block diagram showing the conventional electric discharge surface treating method.

The inventors conducted an experiment and found the following results. An electric discharge was generated between the metal workpiece material and an electrode made of a material such as Ti for composing a hard carbide. Then, it was confirmed that a strong hard coating film could be formed on the metal workpiece surface as the coating layer without the remelting processing or the second processing shown in FIG. 15*b*. Then, an electric discharge was generated between the metal workpiece material and a green compact electrode of metal hydride such as TiH2. Then, it was found that a hard coating film with rich adhesion could be formed faster than the case using Ti as the electrode material. Moreover, an electric discharge was generated between the metal workpiece material and a green compact electrode of metal hydride such as TiH2 mixed with another metal or ceramics. Then, it was confirmed that a hard coating film with various characteristics of hardness, wear resistance and so on could be formed quickly.

Description will be made on nitriding hereafter with respect to several embodiments of this invention. The nitriding reforms and improves the coating layers formed by using the metal electrode made of Ti or the like, the green compact electrode made of metal hydride such as TiH2 and the green compact electrode made of metal hydride such as TiH2 mixed with another metal or ceramics.

FIG. 1 schematically shows an electric discharge surface treating apparatus according to a first embodiment of the invention.

Referring to FIG. 1, a cutting tool or an end mill 101*a* is used as a workpiece in this embodiment. A workpiece holder unit 102 holds the end mill 101*a*. The holder unit 102 has a mechanism for rotating the end mill 101*a* by a command of a NC unit 100 if necessary. A drive unit 103 moves the holder unit 102 in X-axis, Y-axis and Z-axis directions or to a desired angle and position by a command of the NC unit 100. A green compact electrode 104 is made of TiH2 or the like. An electrode holder unit 105 holds the green compact electrode 104. The end mill 101*a* and the electrode 104 are accommodated in a working vessel 106. The working vessel 106 contains a working fluid 107 in which the end mill 101*a* and green compact electrode 104 are dipped. A power source unit 108 supplies power to generate an electric discharge 50 between the electrode 104 and the end mill 101*a*. A nitriding vessel 109 is disposed at the side of the working vessel 106 for nitriding treatment. A lid 110 is attached to an upper end of the nitriding vessel 109 so as to be opened and closed. A heater 111 is disposed on a bottom of an inside of the nitriding vessel 109. A gas supplying unit 112 supplies nitriding gas into the nitriding vessel 109. The end mill 101*a* goes through an electric discharge surface treatment in the working vessel 106 and formed with a coating layer, thereby becoming a surface treated end mill 101*b*. Such end mill 101*b* is transferred and accommodated inside the nitriding vessel 109 for the nitriding treatment. FIG. 1 illustrates a condition in which the end mill 101*b* is being processed by the nitriding.

An electric discharge coating apparatus 114 of this embodiment is composed of the holder unit 102, drive unit 103, green compact electrode 104, holder unit 105 and working vessel 106. A nitriding apparatus 113 of this embodiment is composed of the nitriding vessel 109, lid 110, heater 111 and gas supplying unit 112. The NC control unit 100 controls the operations of the holder unit 105 and power source unit 108 at the working vessel side as well as the heater 111 and gas supplying unit 112 at the nitriding vessel side.

An operation of the surface treating system of this embodiment will be described hereafter.

The electric discharge 50 is generated between the green compact electrode 104 and the end mill 101*a* in the working fluid 107. Then, a coating film of Ti or the like is formed on the end mill 101*a*. In this case, the green compact electrode 104 defines a cathode, while the end mill 101*a* defining an anode.

Even if the polarities of the electrode 104 and end mill 101*a* are reversed, almost the effects are obtained, though there is a little difference. The green compact electrode 104 is worn by the electric discharge 50, so that a coating layer is formed on a surface of the end mill 101*a*. Such coating layer is mainly composed of Ti which is a component of the electrode 104. In other words, a reforming material (in this case Ti) contained in the electrode 104 moves from the electrode 104 to the surface of the end mill 101*a* as a workpiece. Thus, the coating layer containing the reforming material is formed on the metal surface of the workpiece. In embodying the invention, the electrode 104 is not limited to the green compact electrode of TiH2, but may be a solid Ti electrode or another Ti group electrode. However, the green compact electrode 104 of TiH2 is advantageous in view of a forming speed or rate, adhesion, easy treatment and the like of the coating layer provided on the end mill 101*a*.

The present embodiment utilizes the electrode 104 which is basically composed of metal hydride, for the following reasons. In general, the metal hydride is unstable and decomposed at a temperature of some hundreds degrees centigrade, thereby releasing hydrogen as shown in the next formula.

$$TiH2 \rightarrow Ti+H2$$

Then, in case of the electric discharge using the metal hydride electrode, there is an advantageous effect that the decomposed hydrogen cleans the surface of the end mill 101. In addition, there is another advantageous effect that the coating speed becomes faster, since the metal hydride electrode is easily broken by heat of the electric discharge.

The coating film or layer is formed by the electric discharge between the end mill 101*a* and the TiH2 green compact electrode 104. Such coating layer is mainly composed of TiC. This is because the working fluid 107 is an oil. In detail, C (carbon) is thermally decomposed from the oil by the electric discharge. The carbon chemically reacts with Ti in the green compact electrode 104 by the heat, thereby making TiC as shown in the next formula.

$$Ti+C \rightarrow TiC$$

TiC is a very hard substance having Vickers Hardness of 2000–3000 and serves as a coating layer of high quality. Of course, in case of replacing Ti electrode for another electrode composed of V (vanadium), Nb (niobium), Ta (tantalum) or the like whose carbide is a hard material, the same effects are obtained.

An operation for nitriding the end mill 101*b* formed with the coating layer mainly containing TiC will be described hereunder.

In the nitriding vessel 109, a nitrogen gas is spouted and injected from the gas supplying unit 112, so that the inside of the vessel 109 is kept in a nitrogen gas atmosphere. The lid 110 is opened when the end mill 101*b* as a workpiece tool is put in and taken out of the nitriding vessel 109, and closed when the nitriding is performed in the nitrogen gas atmosphere. During nitriding, the heater 111 heats the end mill 101*b* as a nitriding object at some hundreds ° C. in the nitrogen gas atmosphere in the vessel 109. Then, the end mill 101*b* is finished nitriding.

Thus, non-reacted Ti existing in the coating layer becomes TiN by nitriding the end mill 101*b*. At the same time, the nitriding changes TiC which is the principal component of the coating layer into TiCN. TiCN defines a better coating layer than TiC as the coating for the tool. TiCN has nearly the same hardness as TiC, but its affinity with iron is lower than TiC. Accordingly, TiCN is superior to TiC as the coating material of the tool.

In general, the TiCN coating is layered by PVD (physical vapor deposition). However, a PVD device for such deposition is very unstable and hard to handle but for expertise. Moreover, the PVD needs a complicated and expensive device. On the other hand, in the present embodiment, the TiCN coating layer can be formed by using a simple method of an ED treatment and nitriding treatment.

The nitriding vessel 109 and the working vessel 106 may be unified in one vessel so that such single vessel is used for the ED treatment and nitriding treatment alternately. Of course, these respective vessels may be independently provided as in this embodiment. The working fluid 107 may be sprayed on the end mill 101*a* and electrode 104 at the time of EDM, instead of dipping them in the working fluid 107. Moreover, it is possible to perform the nitriding by setting the inside of the vessel into the nitrogenous atmosphere simultaneously when conducting EDM while spraying the working fluid 107.

At this time, ammonia gas is also applicable other than nitrogen gas as for the gas spouted from the gas supplying unit 112 for nitriding. From the viewpoint of a chemical reaction of the nitriding treatment, it is more preferable to use the ammonia gas. Still, the ammonia gas has a strong odor. Therefore, it needs some device to deal with the odor. Moreover, it requires a safety management in manufacturing steps. Therefore, the nitrogen gas is better in view of such safety management.

The coating layer obtained by ED surface treatment is mainly composed of TiC. However, it has residual non-reacted Ti, too, so that it may occasionally causes a problem for the coating of the tool such as the end mill 101*b*. This is because the metal Ti shows high affinity with iron. That is, when machining the iron (steel) as a workpiece by the tool or the end mill 101*b*, the iron may melt and adhere to the end mill or the coating layer may be peeled off from the end mill.

Generally, it is preferable to reduce the affinity of the coating layer (of the tool or the like) with the iron as low as possible. Therefore, in the ED surface treating method of this embodiment, the nitriding treatment is conducted for decreasing the affinity. With the nitriding, the non-reacted Ti existing in the coating layer is changed into TiN, so that the affinity between the coating layer and the iron is lowered very much.

A cutting test was carried out using the end mill 101*b* treated with the nitriding of the present embodiment.

Where a hard coating was layered on the end mill 101*b* by the TiH2 green compact electrode 104, the life of the end mill 101*b* was nearly twice as long as that of an untreated end mill. Moreover, where the end mill 101*b* was treated by the nitriding after being formed with the hard coating layer by EDM of the TiH2 electrode, the life of the end mill 101*b* was extended up to nearly three times as long as that of the untreated end mill.

Figure 2:
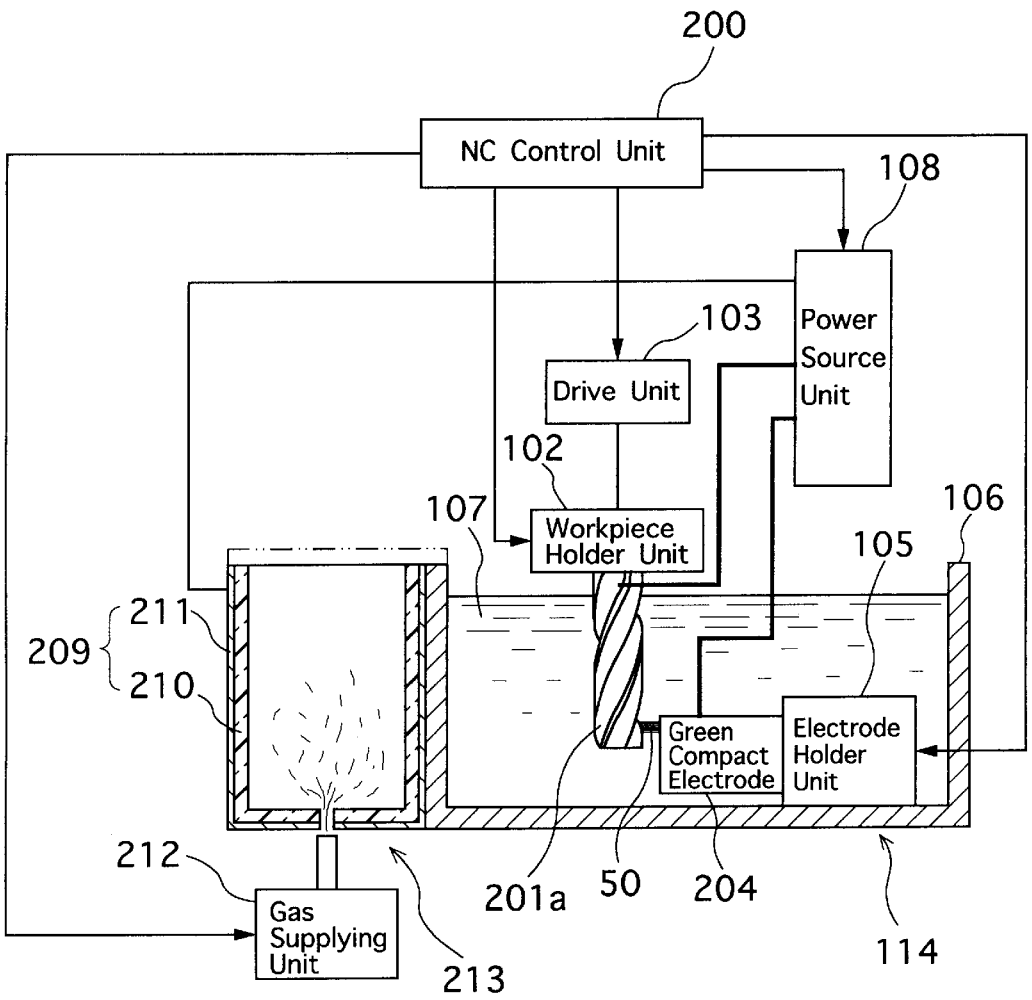
FIG. 2 is a schematic view showing an electric discharge surface treating apparatus according to a second embodiment of the invention.

FIG. 2 schematically shows an electric discharge surface treating apparatus according to a second embodiment of the invention.

Referring to FIG. 2, the ED surface treating apparatus has substantially the same structure as the ED surface treating apparatus of the first embodiment. The power source unit 108 may be an intermittent pulse power source, high frequency AC power source, a silent discharge power source or the like, as desired, to generate an electric discharge. An end mill 201*a* is the same as the end mill 101*a* of the first embodiment. A green compact electrode 204 is made of TiH2 as in the first embodiment. It may be an electrode containing a raw material of the reforming material which becomes the reforming material by the reaction. Otherwise, it may be a solid Ti electrode. However, an electrode having no reforming material may be used if it can form a coating layer on the surface of the workpiece. Basically, any electrode can be used as long as it produces a coating material which becomes hard by nitriding.

Figure 3:
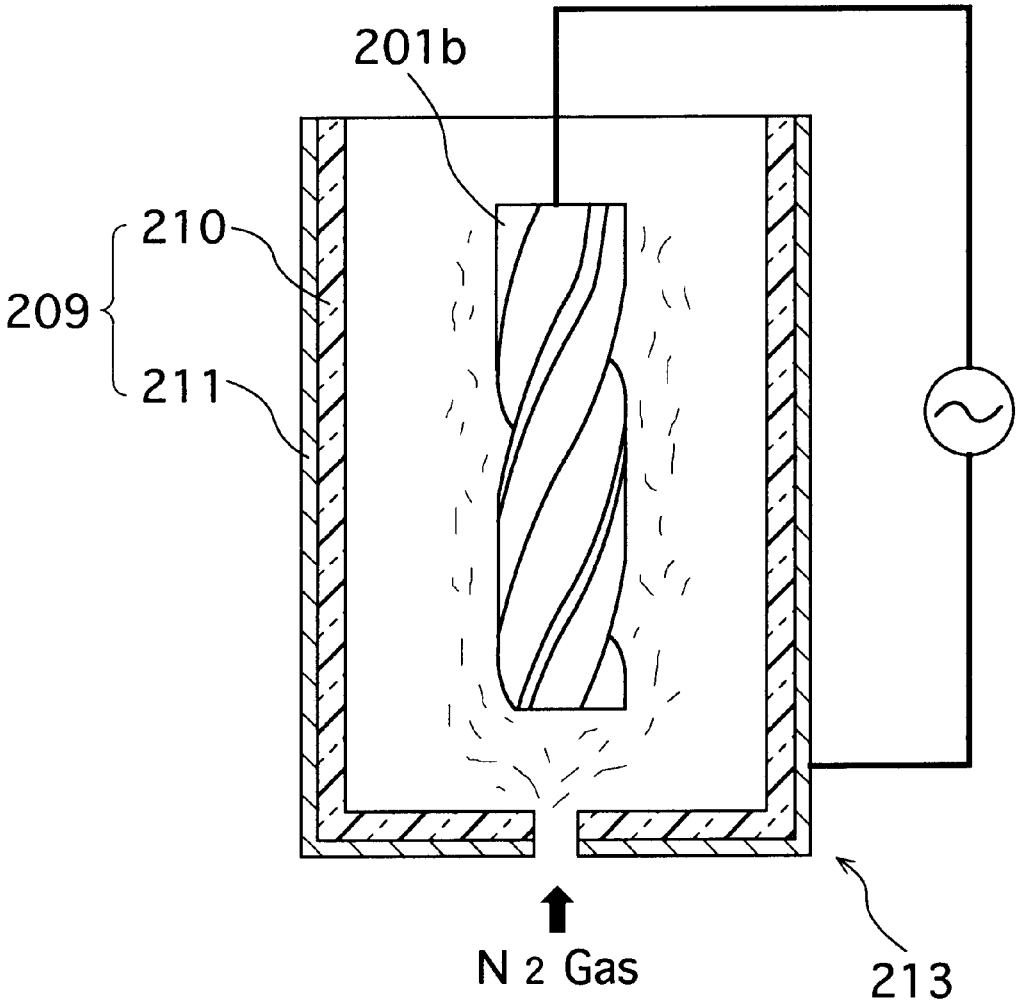
FIG. 3 is a schematic view showing a device used in a nitriding step by a silent discharge in the surface treating system of the second embodiment.

On the other hand, the present embodiment has a different structure of nitriding system. Namely, a nitriding vessel 209 is disposed at the side of the working vessel 106 for nitriding treatment. It has a glass container 210 layered on an inner surface of a metal vessel 211. A gas supplying unit 212 supplies nitriding gas into the nitriding vessel 209. Referring to FIG. 3, the nitriding vessel 209 accommodates therein an end mill 201*b* which was obtained by coating a film layer on a surface of the end mill 201*a*.

A nitriding apparatus 213 of this embodiment is composed of the nitriding vessel 209 and gas supplying unit 212. An NC control unit 200 controls the operations of the holder unit 102, drive unit 103, holder unit 105 and power source unit 108 at the working vessel side as well as the gas supplying unit 212 at the nitriding vessel side.

A coating layer mainly composed of Ti or the like is formed on the end mill 201*a* to define the end mill 201*b* by the same operation as in the first embodiment. Then, a nitriding operation of the end mill 201*b* will be described hereunder.

Nitrogen gas is ejected from the gas supplying unit 212 in the inside of the nitriding vessel 209. Then, the inside is kept in a nitrogenous atmosphere. Under the command from the NC unit 200, the end mill 201*b* finished by the ED surface treatment is moved to the nitriding vessel 209. A silent discharge (AC discharge from a dielectric) is generated in the nitriding vessel 209 for nitriding of the end mill 201*b*. In this case, the frequency is preferably about 200 kHz and the voltage is preferably about 10 KV.

FIG. 3 schematically shows a nitriding process using a silent discharge in the surface treating system of the second embodiment.

Referring to FIG. 3, the silent discharge is generated between the end mill 201*b* and the metal vessel 211 in the nitriding vessel 209. Namely, a voltage applied between the end mill 201*b* and the metal vessel 211 is an AC voltage of some kilovolts (kV). Such voltage induces electric charge toward the glass container 210. Then, the electric charge is discharged to generate the silent discharge between the end mill 201*b* and the glass container 210. Though the silent discharge has an extremely weak power for machining, it acts to strongly cause a chemical reaction. If the silent discharge is generated in the nitrogenous atmosphere, the nitriding reaction can be promoted.

The container 210 may be made of another dielectric than the glass. Moreover, the frequency is preferably tens Hz to some MHz and the voltage is preferably tens V to some MV in the silent discharge. Furthermore, the nitriding gas spouted from the gas supplying unit 212 may be an ammonia gas as in the first embodiment.

The present embodiment conducts ED coating treatment so as to provide the tool or the like with a coating film layer such as TiC+Ti layer containing a mixture of TiC and Ti. Then, the nitriding treatment is performed on the coating layer of the tool by an electric discharge such as a glow discharge, corona discharge, silent discharge, pulsed arc discharge, or high frequency AC arc discharge. The nitriding treatment may be performed by heating the treated surface at 500° C. or more and supplying nitrogen gas or ammonia gas onto such heated surface so as to cause the nitriding reaction. Moreover, it may be performed by soaking the treated surface in a molten salt such as potassium cyanide (KCN). Furthermore, it may be conducted by supplying the nitrogen gas while heating the tool surface by a laser.

In such nitrided coating layer, a superficial part composed of TiC and Ti is nitrided best. A nitriding degree gradually decreases toward the inside of the coating layer. It means that the coating layer is in a nitriding state having an inclination. That is, the coating layer has a high density of TiCN and TiN at the superficial part, while gradually increasing a density of TiC and Ti toward the inside.

To the contrary, a nitriding layer is conventionally formed on a cutting tool or the like by a vapor plating, i.e. CVD (chemical vapor deposition) or PVD (physical vapor deposition). With such method, plasma made from TiN or TiAlN is coated on the cutting tool. With the CVD and PVD, though the coating layer of TiN or TiAlN adheres to the surface of the workpiece or tool, it is not diffused in the workpiece. Moreover, the coating layer of TiN or TiAlN is equally nitrided in every thickness direction.

Next, the coating layer having the inclination of this embodiment will be compared to the coating layer uniformly covered with TiN or the like by the conventional PVD or the like.

(1) When an external force or heat is applied to the surface of the coating layer having the inclined structure, such coating layer transmits it to the base metal while damping its stress or thermal stress. Therefore, peeling and cracking of the coating layer rarely occur.

The ED surface coating is advantageous for attenuating the stress or thermal stress, too, since the Ti density becomes larger toward the inside of the coating layer. This is because the surface of the coating layer is protected by TiCN or TiN whose wear resistance is high and whose affinity with a processed material is low. Simultaneously, the stress or thermal stress can be damped by the Ti which has a larger toughness toward the inside of the coating layer.

(2) The TiC+Ti coating layer is sintered by the electric discharge and strongly diffused into the base metal by a high temperature and high pressure which is generated for a very short time at the time of electric discharge. Therefore, if the coating layer is thickly formed on the workpiece by the electric discharge coating, such coating layer is hard to peel off.

Accordingly, even if the nitriding layer is thickened to a great degree, its inclination is kept as it is and adhesion does not deteriorate. To the contrary, if the nitriding layer is made by PVD to a thickness of 3 $\mu$m or more, for instance, its adhesion gets worse. That is like a phenomenon that a plating layer is easily peeled off from the workpiece if it is thick.

(3) When TiC and residual Ti are nitrided to become TiCN and TiN, a volume of the workpiece is expanded. Then, a residual stress of the coating layer moves in a compressive direction compared to a state treated by the ED surface coating. That is, a tensile stress is usually generated at the machined surface by EDM and the coated surface by ED coating. However, the material is melted in the nitriding process and solidified thereafter. Thus, the residual stress is converted in the compressive direction, thereby preventing the crack of the coating layer.

As mentioned above, it is obviously preferred and very important to conduct the nitriding treatment after forming the coating layer by the ED surface treatment. If the nitriding reaction is performed by the electric discharge in a liquid nitrogen, the same effects are obtained as the above.

The ED coating method embodying the invention will be described hereunder more in detail.

As the ED surface treating method for forming the coating layer, there are some methods: ED in a liquid such as oil, ED in a gaseous atmosphere such as nitrogen, air or argon gas.

First, an example is described wherein the ED surface treatment is performed in an oil or in a gas (air, nitrogenous atmosphere and non-oxide atmosphere such as Ar (argon) or He (helium) other than nitrogen) by using the green compact electrode 104, 204 of TiH2.

[1] Electric Discharge in Oil $$TiH2 \rightarrow Ti+C \text{ (Carbon decomposed from oil)} \rightarrow TiC+Ti \text{ (residual non-carbide)}$$

[2] Electric Discharge in Gas (1) Nitrogenous Atmosphere $$TiH2 \rightarrow Ti+N2 \rightarrow TiN+Ti \text{ (residual non-nitride)}$$

(2) Air (normally an oxide atmosphere and not used)

$$TiH2 \rightarrow Ti+O2+N2 \rightarrow TiO2+TiN+Ti \text{ (residual non-oxide, non-nitride)}$$

(3) Argon Gas $$TiH2 \rightarrow Ti$$

As shown above, there remains Ti other than TiC, TiN and TiO2, without becoming carbide, oxide or nitride.

At this time, if the nitriding treatment is performed on the coating layer made by the electric discharge in oil or in gas, the result is as follows.

[1] Nitriding after Electric Discharge in Oil $$TiC+Ti \rightarrow TiCN+TiN$$

That is, the coating layer surface only has TiCN and TiN, while the residual Ti exists inside the coating layer.

TiCN is a very hard material whose Vickers Hardness is about HV2600. Therefore, this condition is preferable to form the coating for the cutting tool.

[2] Nitriding after Electric Discharge in Gas (1) Nitrogenous Atmosphere $$TiN+Ti \rightarrow TiN+TiN$$

Namely, the coating layer surface only has TiN, while the residual Ti exists inside the coating layer.

(2) Air (normally an oxide atmosphere and not used)

$$TiO2+TiN+Ti \rightarrow TiO2+TiN+TiN$$

TiO2 has a low hardness of about HV980. Therefore, this condition is not used. In embodying the invention, it is necessary to prevent TiO2 from generating by circulating N2 gas.

(3) Argon Gas $$Ti \rightarrow TiN$$

(NB) Here, though the nitrogen gas is commonly shown as N2, it becomes an atom in nitriding reaction. Therefore, it is shown as N herein.

Nitriding treatment in embodying this invention will be described hereafter.

There are some nitriding methods. Specifically, one utilizes the electric discharge. Another one heats the coating layer at 500° C. or more and supplies nitrogen gas or ammonia gas on the coating layer surface. Still another one soaks the workpiece in molten salt. Still another one utilizes electrolysis. Still another one uses laser heating.

[1] Nitriding Method using Electric Discharge (1) Glow Discharge, Corona Discharge The discharge current is very weak. However, they ionize nitrogen gas, thereby generating a nitriding action. At this time, their average temperature rise is 100° C. or less, which is nearly an ordinary temperature rise, so that the metal workpiece is hard to transform.

(2) Silent Discharge

In view of a phenomenon of the electric discharge, it looks like the corona discharge. An insulator is placed between the coating layer of the workpiece and an electrode, by forming a glass layer or the like on the electrode surface. A high frequency high voltage AC power source is used to generate an electric discharge between charges appearing on the insulator and the coating layer. If the voltage and frequency is high, an input power can be large. Since the silent discharge is not easily changed into an arc discharge, the electric discharge does not concentrate on a specific point.

Here, if the input power is ω, a dielectric constant is ∈, a voltage is V and a frequency is f, the following expression is obtained.

$$\omega \in \cdot v \cdot f$$

With the silent discharge, it is easy to keep the average temperature at 500° C. or less. In addition, nitrogen gas is ionized, thereby presenting an nitriding action.

(3) High Frequency AC Arc Discharge

It is a power source system used in a wire electric discharge machining or the like. There is an arc discharge of high current density at a discharge point. Therefore, a discharge point temperature reaches a boiling point of the coating layer, though at a minute area. As a result, a chemical reaction of the nitriding is intense, and the electric discharge easily reaches tens μm in depth from the surface of the coating layer. Though the discharge point temperature is very high, an average temperature of the coating layer is low. It is about 50° C. or less in liquid as is known in the ED in liquid. It is easy to keep the average temperature not more than a softening temperature of a hardened steel, too, even in the ED in gas. An anode-cathode distance tends to be narrow, so that it is preferable to set the voltage high.

(4) Intermittent Pulsed Arc Discharge

It is the same power source as that of a die-sinking electric discharge machining. It is an arc discharge of high ED current density as in the discharge of (3). Therefore, the nitriding reaction of the discharge point is intense as in the discharge of (3). So is the temperature rise or the like, and the average temperature is low. The difference from the high frequency AC arc discharge lies in that the electric discharge using the high frequency AC is repeated while the polarities are converted by turns. Thus, just a very short quiescent time exists before or after the conversion of polarities therein. Accordingly, the electric discharge may be generated at the same discharge point as the point where the previous electric discharge took place. Then, it possibly causes "high frequency arc". To the contrary, the intermittent pulsed arc discharge can specify and get the quiescent time as desired, so that the control of the quiescent time is possible.

In any of the nitriding methods using the electric discharge as mentioned above, the average temperatures is kept at 100° C. or less at the highest, though the temperature of the discharge points is high. Therefore, even if a steel as a workpiece is processed by quench hardening or the like, the base metal can become nitride without lowering the hardness. Moreover, the workpiece can become nitride to tens μm in depth from its surface because of the high temperature at the discharge point. Particularly, since the ED nitriding treatment can get the nitriding depth up to such tens μm, a life of a cutting tool as workpiece extends ten times or more.

In the ED coating treatment in nitrogen gas atmosphere, the anode-cathode distance is comparatively narrow, though it uses the same voltage as the electric discharge in liquid. Therefore, such coating treatment is easy to generate short circuits. To prevent such short circuits, it is useful to set the voltage of the EDM high. Otherwise, it is preferred to rotate the end mill 201*b* also in the nitriding treatment, by mounting it to the holder unit 202 in the same manner as in the ED coating described referring to FIG. 2.

[2] Method to Heat the Coating Layer at 500° C. or more and Supply Nitrogen Gas or Ammonia Gas on the Surface of the Coating Layer As described above, this method is easily practiced and has a practical effect in case of nitriding the coating layer while heating it at 500° C. or more, preferably to nearly 700° C. Therefore, there is a high possibility that such method is used in many cases. Nevertheless, it is highly possible that the hardness is lowered in case of the hardened steel. Moreover, in case of nitriding by heating, the nitrogen gas is just a high temperature gas, so that there is a possibility that it is ionized or dissociated a little. Still, since the nitrogen gas is not ionized as much as in the method using the electric discharge phenomenon mentioned above, a chemically reacting area is limited to a very thin layer (a few μm) of the surface of the coating layer. In order to make the coating layer react as deeply as possible, it is necessary to heighten the heating temperature and lengthen the heating time. Therefore, this method serves for a workpiece such as the hard metal or a certain kind of high speed steel. However, this method is not preferred for a workpiece or base metal which lowers a hardness of quench hardening.

In this method, the ammonia may be used instead of nitrogen gas. When using the ammonia, it can lower the reacting temperature. That is, when NH3 (ammonia) is decomposed, N is at a nascent state, so that the reaction is activated. NH3 is advantageous from viewpoints of a mass production, although the treatment is troublesome because of a problem of its odor, as mentioned before.

[3] Method to Soak the Workpiece in Molten Salt

A cyanide such as KCN is melted and a workpiece formed with the coating layer is soaked therein. This method has advantageous effects to easily keep a working condition constant, though it is necessary to fully assure safety. In order to make the nitriding reaction faster, the electrolysis may be performed in a molten salt bath by setting the workpiece treated by ED coating at an anode side.

[4] Method of Electrolysis

The electrolysis is performed in an aqueous solution of cyanide such as KCN, NaCN, by setting the coating layer made by electric discharge as the anode. Although the nitriding is attained only at the surface of the coating layer, an operation in work is easy in this method.

[5] Method of Laser Heating

The laser is irradiated to the workpiece surface treated by ED coating, while supplying nitrogen gas thereto. The nitriding can reach a degree of about 20–40 μm in depth by keeping an energy density of the laser to such a degree as to make a temperature of the machined part exceed its melting point a little. However, this method has a possibility that a scar of a sweep is left by the laser irradiation.

Though there are various nitriding systems as mentioned above, this embodiment composes a new nitride for nitriding the workpiece surface, without making the nitrogen infiltrate into the steel or the like. Accordingly, it is possible to decrease the affinity with a metal workpiece in case of cutting work or plastic working or in case the metal workpiece touches and moves relative to the tool at a high pressure and high temperature.

Figure 4:
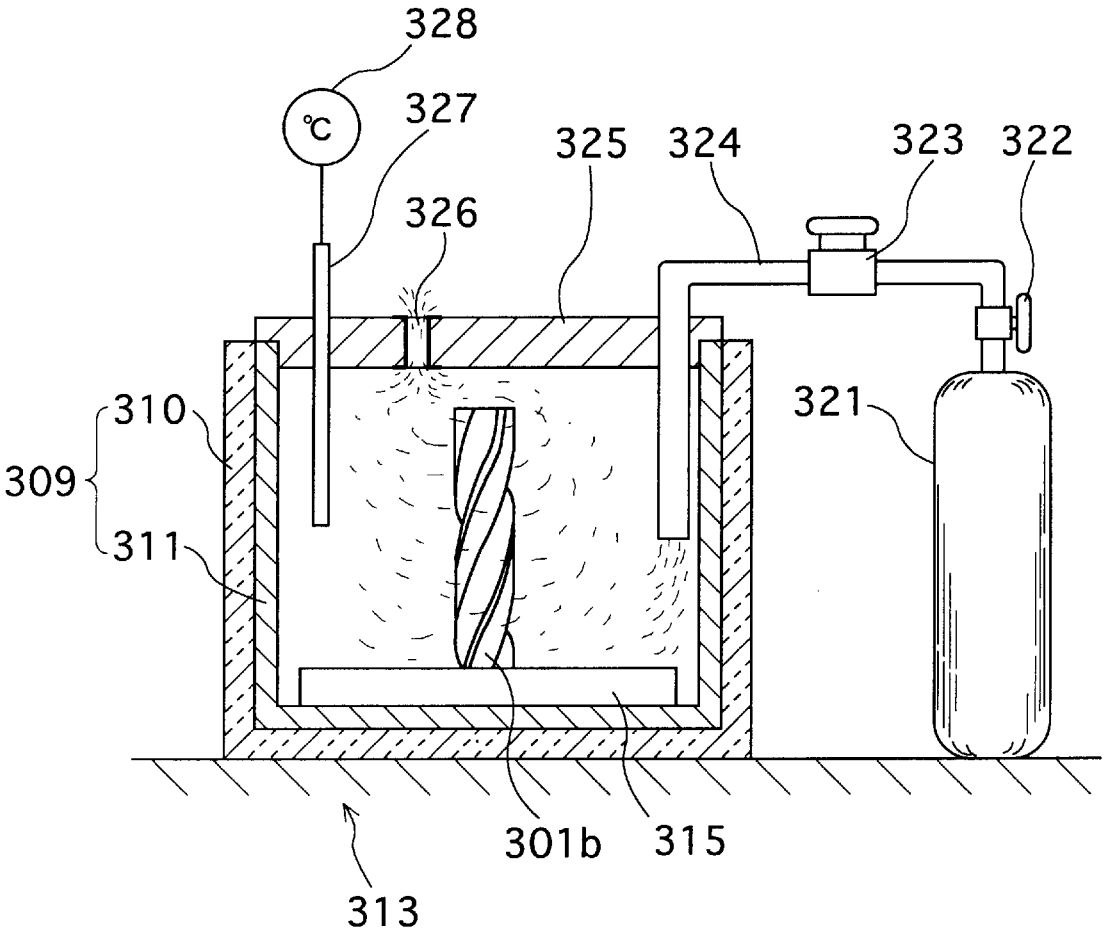
FIG. 4 is a schematic view showing a device used in a nitriding step by a silent discharge in an electric discharge surface treating system according to a third embodiment of the invention.

The inventors made up an ED surface treating apparatus according to a third embodiment of the invention shown in FIG. 4 and obtained specific data as an example. This example shows that the nitriding on the coating surface treated by ED surface treatment has a very useful function and effects.

FIG. 4 schematically shows a device used in a nitriding step by a silent discharge in an electric discharge surface treating system according to the third embodiment of the invention.

Referring to FIG. 4, a gas cylinder 321 contains a liquid nitrogen therein. A nitrogen gas is supplied from the gas cylinder 321 to a pipe 324 via a valve 322. A pressure governor 323 serves for governing a pressure of the nitrogen gas ejected from the pipe 324 at a fixed pressure. The pipe 324 has an opening end inserted in a nitriding vessel 309 for nitriding treatment to a position lower than a vertical center of the vessel 309. A metal lid 325 made of iron or stainless covers an opening at a top of the vessel 309 and acts to keep a temperature of the nitrogen gas. The lid 325 has a vent hole 326. A chromel-alumel thermocouple 327 is fitted through the lid 325 in a thermally insulated state, so as to be inserted into the vessel 309. A temperature gauge 328 is connected to the thermocouple 327 to display a temperature by an output from the thermocouple 327.

A metal vessel 311 is made of iron or stainless. A heat insulating portion 310 is made of a thermal insulator covering an outside of the metal vessel 311. The nitriding vessel 309 is composed of the metal vessel 311 and heat insulating portion 310. A heater 315 is disposed inside the vessel 309. An end mill 301*b* is a sample tool (base metal made of hard metal GTi), after the coating treatment by the electric discharge in oil. An end mill 301*b* is formed with the coating layer on the surface and accommodated in the vessel 309. Specifically, the end mill 301*b* is commonly made up of a steel material such as a hard metal or a high speed steel for drill.

A nitriding device 313 is constructed of the nitriding vessel 309, gas cylinder 321, valve 322, pipe 324 and the like.

A nitriding treatment in the ED surface treating apparatus of this embodiment is described hereunder.

At first, a green compact electrode (not shown) was formed by compression molding of TiH2 at a pressure ratio of 5 ton/cm2. Then, a cutting tool tip for lathe turning made of hard metal (GTi30) was processed by the ED coating treatment by use of such green compact electrode. At this time, a condition of the ED coating treatment was: a discharge current Ip=8 A, pulse width Zp=2 μs, quiescent time of 32 μs, ED processing time of 5 minutes, and working fluid of kerosene.

Then, the end mill 301*b* was coated by the ED coating treatment in oil. Thereafter, the end mill 301*b* was put in the nitriding vessel 309 and heated by the heater 315 for ten minutes so that the gauge 328 shows a temperature of 700° C. N2 gas was ejected from the gas cylinder 321 and supplied therein via the pipe 324. At this moment, a gas pressure of N2 in the nitriding vessel 309 was substantially an air pressure. In this way, a nitriding reaction was generated at a very thin layer of tens μm of a superficial layer of the end mill 301*b* as the workpiece.

The end mill 301*b* underwent a cutting test for evaluation, in which comparison was made between the one treated by the nitriding device 313 and another one only having the coating layer treated by the ED coating treatment. As a result, the nitrided one had its cutting life greatly prolonged. That is, if the life of the hard metal one without surface treatment was "1", the life of the one having only the ED coating was "2 to 4", and the life of the nitriding one after the coating treatment was "7 to 8". Another green compact electrode was prepared by compression molding of TiH2 added with AlN at a rate of 7:3. The electric discharge treatment was conducted on the workpiece by using such electrode. Then, such workpiece was treated by the nitriding as shown above. As a result, it was found that the life thereof was extended as in the above case.

Namely, according to the cutting test results, the cutting lives of the nitriding one, ED coated one and a hard metal without any treatment were as shown above. Moreover, the life of the nitriding one is nearly twice as long as that of the one having only the coating.

Particularly, the nitriding by ED reaches to tens μm in depth. Accordingly, it was found from the cutting test that the cutting life was extended ten times or more compared with the cutting life of the workpiece without the ED nitriding.

Various kinds of specific examples will be described hereunder about another electric discharge treatment or nitriding treatment that the inventors conducted.

While, in the before mentioned example of the coating treatment for the cutting tool, the green compact electrode of TiH2 or the like is used, another electrode may be used. An electrode was made of a hydride of a transition metal such as VH, ZrH, TaH2. In addition, an electrode was made of such hydride mixed with one or more materials like V, VC, Al2O3, TiB2, AlN, TiN, Nb, NbN. It was also confirmed that the same function and effects were attained with either electrode.

Moreover, it was confirmed that the above method was applicable to other metals than the cutting tool. Namely, it can be used for nitriding a transition metal surface provided by plating, thermal spraying, powder metallurgy or the like. For example, it is applicable in case of giving high wear resistance to partial or all surface of a die or the like, or to an agricultural machine or implement, constructor's tool, tool for treating earth and sand, etc.

With the ED surface treating method or apparatus constructed as in the above embodiments, it is possible to form a better hard layer on the surface of the end mill 101*a*, 201*a* whether the material of the workpiece is steel or hard metal.

While the metal workpiece of the above embodiments is the end mill 101*a*, 201*a*, it may be any other ones which need corrosion resistance and wear resistance as a matter of course. For example, it may be any tool, die, machine structure, machine parts or the like which need surface treatment.

In the ED surface treating method and apparatus of the above embodiments, the electrode 104, 204 can be formed of powders of metal hydride such as TiH2. Therefore, the coating layer of high hardness and better adhesion can be formed on the metal surface whether the material of the workpiece is steel or hard metal. Additionally, the hard film can be coated on the metal workpiece surface without the secondary processing. Moreover, if such electrode 104, 204 is used to generate the electric discharge for the metal workpiece material, the hard film can be formed faster and adhere more strongly than that with the electrode of Ti or the like. The electrode 104, 204 can be formed by the hydride such as TiH2 mixed with another metal or ceramics. If such electrode is used to generate the electric discharge, the hard film can be formed rapidly, while having various characteristics of hardness, wear resistance and so on.

In the ED surface treating method and apparatus of the above embodiments, the electrode 104, 204 can be formed of a metal or metal compound whose carbide and nitride are both hard materials having Vickers Hardness of 1000Hv or more. Therefore, if the electrode is formed of a material becoming a hard carbide such as Ti and used for electric discharge with the metal workpiece material, a strong hard film can be formed on the metal surface without the processing of remelting. Consequently, a coating layer of high quality can be formed fast and uniformly whether the material of the workpiece is steel or hard metal.

In the first embodiment, the lid 110 of the nitriding vessel 109 heightens effective utilization factor of the nitriding gas. Therefore, the lid 110 may be omitted. Otherwise, the vessel 109 may have only an opening of a specific area. Moreover, the vessel 109 may have only the lower end opened.

In the ED surface treating method and apparatus of the above embodiments, the surface of the metal workpiece such as the end mill 101*a* can be coated with one or more of ceramics and metals to define the coating layer, and processed by nitriding thereafter. Therefore, if the electric discharge is generated between the workpiece and the solid or green compact electrode 104, 204 mixed with the ceramics or metals, a hard layer of good quality can be formed while given various characteristics of hardness or wear resistance. Moreover, the nitriding treatment can decrease the affinity between iron such as steel and the workpiece. In detail, a new nitride is composed at the workpiece surface so that the surface becomes nitriding. Thus, it is possible to decrease the affinity of the tool with a metal workpiece in the cutting work, plastic work or such work as the metal workpiece is moved while touching the tool at high pressure or high temperature.

Specifically, as described in the second embodiment, a first example of ED surface treating method and apparatus can use the ED phenomenon for the nitriding. Namely, in the first example, the coated metal workpiece surface is nitrided in gas or liquid nitrogen by the glow discharge, corona discharge, silent discharge, intermittent pulsed arc discharge or high frequency AC arc discharge. Therefore, in addition to the advantageous effects as mentioned above, the superficial part of the coating surface is most nitrided, while gradually decreasing a nitriding degree toward the inside. That is, the coating layer has a nitriding state having an inclination. Thus, if an external force and heat is applied to the workpiece surface, the coating layer having such inclination structure transmits them to the workpiece, while damping their stress or thermal stress. Therefore, the peeling and cracking of the coating layer is hard to occur, and it is advantageous to damp the stress and thermal stress. Moreover, the coating layer or reforming materials are intensely diffused inside the workpiece. Consequently, if the coating layer is thickly layered on the workpiece by electric charge, there takes place no peeling-off. In addition, the volume is expanded, so that the residual stress moves to the compressive one. Namely, the tensile stress is usually generated on the EDM surface and the ED coating surface. However, once melted material is solidified in the nitriding process, the residual stress moves in the compressive direction, thereby preventing the crack.

A second example of ED surface treating method and apparatus can perform the nitriding after the coating on the metal workpiece surface, while heating the workpiece at 500° C. or more and supplying the nitrogen gas or ammonia gas to the workpiece surface. As mentioned above, the second example is preferable for the hard metal or a certain kind of high speed steel. The second example has the same effects as the first example, too. Namely, the nitriding has the inclination. The coating layer material is intensely diffused in the workpiece. The residual stress converts to the compressive side.

A third example of ED surface treating method and apparatus can perform the nitriding after the coating on the metal workpiece surface, while soaking the workpiece in the molten salt such as KCN generating the nitriding reaction. In this case, it is easy to constantly keep the treating conditions. Additional electrolysis can be performed to promote the reaction, as mentioned above. This third example has the same effects as the first example, too. Namely, the nitriding has the inclination. The coating layer material is intensely diffused in the workpiece. The residual stress converts to the compressive side.

A fourth example of ED surface treating method and apparatus can perform the nitriding after the coating on the metal workpiece surface, while using the electrolysis in the aqueous solution of cyanide salt such as KCN, NaCN with the coated workpiece as the anode. This fourth example has the advantageous effects as mentioned above. Moreover, the fourth example has the same effects as the first example, too. Namely, the nitriding has the inclination. The coating layer material is intensely diffused in the workpiece. The residual stress converts to the compressive side.

A fifth example of ED surface treating method and apparatus can perform the nitriding after the coating on the metal workpiece surface, while irradiating the laser and supplying the nitrogen gas to the workpiece surface. This fifth example has the advantageous effects as mentioned above. Moreover, the fifth example has the same effects as the first example, too. Namely, the nitriding has the inclination. The coating layer material is intensely diffused in the workpiece. The residual stress converts to the compressive side.

A sixth example of ED surface treating method and apparatus can perform the nitriding after the coating on the metal workpiece surface as follows. That is, the ED coating surface is processed by "polishing as finishing work" by a very fine diamond grindstone, diamond loose abrasive grains, or another hard grindstone or loose abrasive grains. Thereafter, the nitriding treatment is performed thereon. The nitrogen is hard to go into the workpiece surface only treated by EDM. However, since the surface is polished by the polishing method or device or the like, the nitrogen is easy to go into the polished surface layer. Therefore, if the workpiece is processed by a heating treatment such as the quench hardening or the like, a hardened structure does not easily return to the original state.

A seventh embodiment of ED surface treating method and apparatus can perform the nitriding after the coating on the metal workpiece surface as follows. That is, the workpiece is defined by a tool with an abraded cutting edge. The coating layer is formed on the cutting edge thicker than the dull part. Then, the cutting edge with the coating layer is sharply re-shaped. Thereafter, the nitriding treatment is conducted thereon. Namely, the edge is sharpened before the hardening operation, i.e. before increasing the hardness by the nitriding treatment. Accordingly, it is easy to finely adjust the cutting edge.

As described above, the inventors have made experiments for the ED surface treatment in the oil with the green compact electrode mainly formed of TiH2. In these experiments, they succeeded to get a coating layer which contained high amount of TiC generated by uniting Ti and a decomposed carbon in the working fluid in the discharge. It had a strong adhesion and a high hardness. The surface roughness was 6 $\mu$mRz for the hard metal and 9 $\mu$mRz for the steel. Compared with the workpiece surface processed by a green compact electrode of WC—Co or well-known thermally sprayed coating surface, the finishing surface is pretty good. However it does not reach 1 $\mu$mRz which is requested for the surface of the cutting tools or cold forging die tools.

Then, a fourth embodiment of the invention uses a grinding technique and a nitriding technique in combination. The fourth embodiment is described referring to FIGS. 5 to 11.

First, a green compact electrode is formed by compression molding of a metal having carbonizing and hardening properties, for example a metal hydride such as TiH2. A workpiece made of steel or sintered hard metal of WC—Co or the like is processed by an electric discharge in a working fluid which is decomposed to produce a carbide, for example an oil. Thus, the workpiece surface is covered with a carbide of the electrode material. Then, the electrically discharged surface is mechanically polished or ground with a tool, for example, as shown in FIG. 5.

Figure 5:
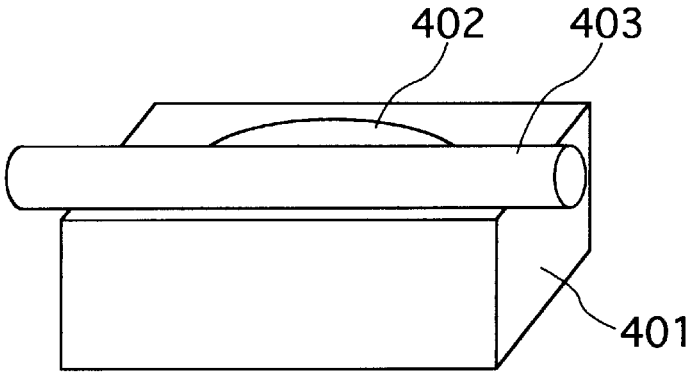
FIG. 5 is an explanatory drawing showing an electric discharge surface treating method according to a fourth embodiment of the invention.

FIG. 5 shows an electric discharge surface treating method according to the fourth embodiment of the invention. Referring to FIG. 5, a base metal or base metal 401 as a workpiece is provided with an electrically discharged surface 402. A round bar 403 serves as a mechanical polishing tool. The round bar 403 has a surface coated with a diamond paste which is kneaded by oil and has about 1 to 3 $\mu$m in diameter. The round bar 403 is used to mechanically polish the discharged surface 402 of the base metal 401. In this embodiment, the EDM was performed in oil under the following conditions. The polishing time was ten minutes.

Electrode: Green compact of titanium hydride (TiH2)

Electrode polarity: Negative

Discharge current value Ip: 8 A

Pulse width Ton: 2 $\mu$s

Quiescent time Toff: 255 $\mu$s

Machining time: 5 minutes

Workpiece: Tungsten carbide cobalt (WC—Co) and special tool steel (SKD-11)

Figure 6:
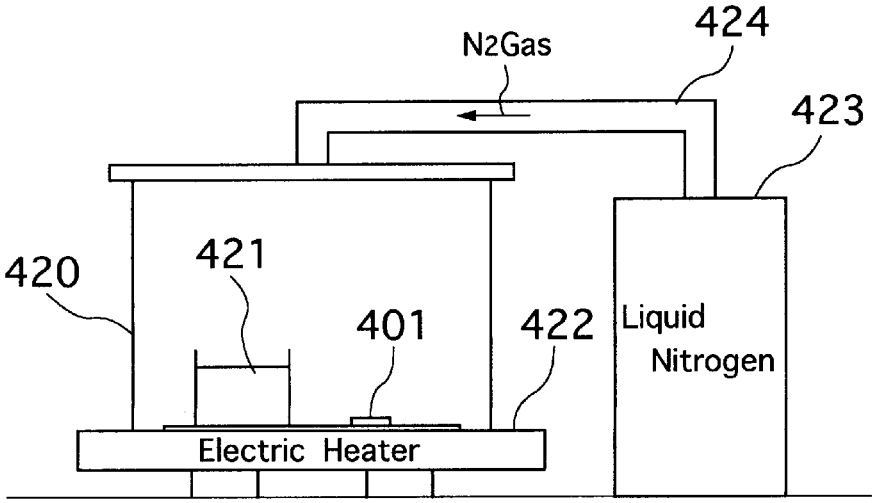
FIG. 6 is a schematic view showing a nitriding apparatus according to the fourth embodiment of the invention.

Next, the polished base metal 401 is treated by nitriding. FIG. 6 schematically shows a nitriding apparatus according to the fourth embodiment of the invention.

Referring to FIG. 6, a housing 420 is provided to accommodate the base metal 401 therein. A first container 421 is accommodated also in the housing 420 for containing a liquid nitrogen. An electric heater 422 is disposed under the housing 421 to heat the base metal 401. A second container 423 is disposed at an outside of the housing 420 for containing a liquid nitrogen. A pipe 424 guides the liquid nitrogen from the second container 423 to the housing 420. The liquid nitrogen is supplied in the first container 421 beforehand so as to fill up the inside of the housing 420 with the nitrogen, thereby preventing the base metal 401 from oxidation.

Figure 7:
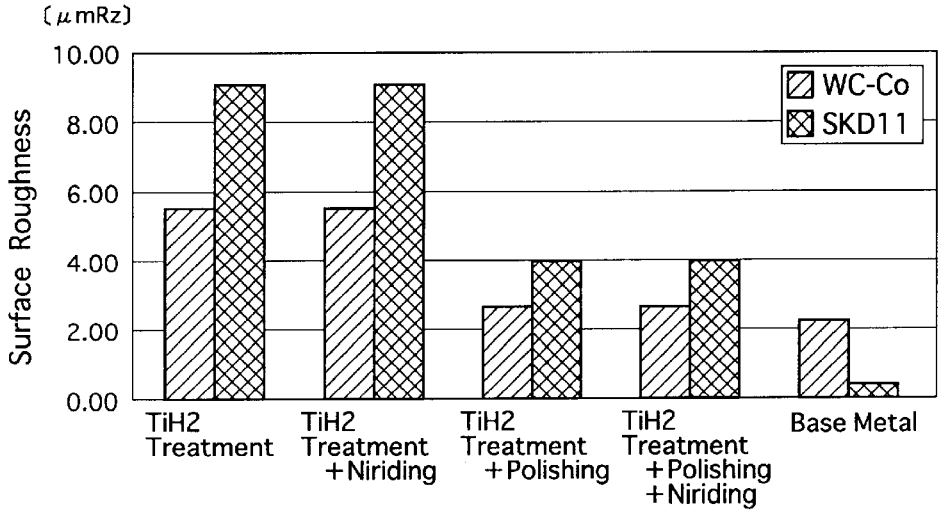
FIG. 7 is a graph showing a measured surface roughness of a workpiece which was processed by a nitriding treatment of the fourth embodiment.
Figure 8:
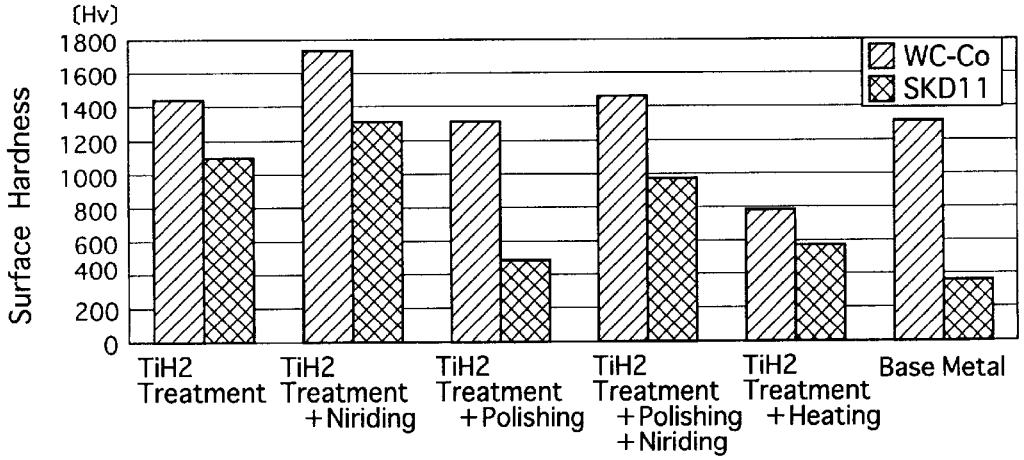
FIG. 8 is a graph showing a measured surface hardness of a workpiece which was processed by a nitriding treatment of the fourth embodiment.

FIG. 7 shows finished surface roughness of workpiece with different kind of treatment including nitriding treatment of the fourth embodiment of the invention. FIG. 8 shows surface hardness of workpiece with different kind of treatment including nitriding treatment of the fourth embodiment of the invention.

Nitriding treatment was conducted on the base metal by the apparatus described above. The nitriding treatment was performed for 10 min at 500° C. of an inside temperature of the housing 420. Resulting finished surface roughness and surface hardness are shown in FIGS. 7 and 8, respectively. Referring to FIG. 7, the left-hand hatched and crosshatched bars show finished surface roughness measured on a first base metal electrically discharged by TiH2 green compact electrode. The next bars show such roughness measured on a second base metal obtained by nitriding the first base metal. The third bars show such roughness measured on a third base metal whose surface was treated by TiH2 green compact electrode and further polished thereafter. The fourth bars show such roughness measured on a fourth base metal obtained by nitriding the third one. There was substantially no difference or change in the finished surface roughness of the coated but non-polished workpiece before and after nitriding. There was no difference or change in the finished surface roughness of the coated and polished workpiece, either. The base metal used therein are a hard metal of WC—Co (hatched bar) and a steel of SKD11 (crosshatched bar).

FIG. 8 shows surface hardness change before and after nitriding. Referring to FIG. 8, it is clearly shown that, if the coated but non-polished base metal is processed by nitriding, the hardness heightens. That is, the Vickers hardness heightens from Hv1450 to Hv1700 in case of the coated hard metal, while rising from Hv1050 to Hv1300 in case of the steel. It is obvious that the hardness increases by nitriding.

If the coated surface is just polished but not processed by nitriding, the hardness lowers. That is, the Vickers hardness lowers from Hv1450 to Hv1300 in case of the coated hard metal, while falling from Hv1050 to Hv500 in case of the coated steel. In case they are processed by nitriding, the hardness rises to Hv1450 in case of the coated hard metal and to Hv950 in case of the coated steel. It is found that such hardness is much higher than that of the base metal in itself. Still, the hardness of each nitriding workpiece is nearly Hv300 lower than the hardness of the workpiece coated and nitrided without polishing. This may be because the superficial part containing many Ti component and less TiC component is removed. Nevertheless, such hardness is substantially equal to that of the workpiece just coated with TiH2. The finished surface roughness is surely improved. Moreover, it is expected that the hardness thereof increases due to nitriding and that their wear resistance is high.

An abrasion test was carried out according to the Okoshi pin disc abrasion test method. As a result, the abrasion amount in the hard metal coated and polished and nitrided was very small compared with that in the hard metal only coated. It was about one tenth compared with the hard metal electrically discharged by TiH2 green compact electrode.

The conditions in the test are as follows.

Pin Shape: 7.98 mmΦ (0.5 cm2)

Pressure: 0.5 kgf (pressure of 1 kgf/cm2)

Abrasion speed: 1 m/s

Disc: SK-3

Atmosphere: air

Abrasion Amount: abrasion weight after running 25 km

Hard Metal without ED Surface Treatment: 2 mg

Hard Metal with ED Treatment by Ti Electrode: 0.7 mg

Hard Metal with ED Treatment by TiH2 Green Compact Electrode: 0.1 mg

Hard Metal with ED Treatment by TiH2 Green Compact Electrode, Grinding and Nitriding: about 0.01 mg though too small to measure It was checked whether the hardness increase by the nitriding apparatus depends on the mixing of the nitrogen gas or simply on the heating process. Therefore, the hard metal electrically discharged by the TiH2 green compact electrode was processed by a heating treatment in the air under the same conditions as those in the nitriding treatment (at 500° C. and at air pressure). As the result, it was confirmed that the hardness fell down. It is supposed that TiC or the like is oxidized to change into titanium suboxide (TiO), TiO2 or the like. Namely, the hardness decreases compared with that of the base metal, because TiC+Ti layer coated over the base metal surface is oxidized to change into TiO2 or the like. Thus, there is formed a surface layer of lower hardness on the base metal surface even though the hardness of the base metal does not change.

Next, an operation and effects of the fourth embodiment are described.

First, the description is made about a surface state in case the electrically discharged surface is smoothed by mechanical polishing and processed by nitriding thereafter.

Figure 9:
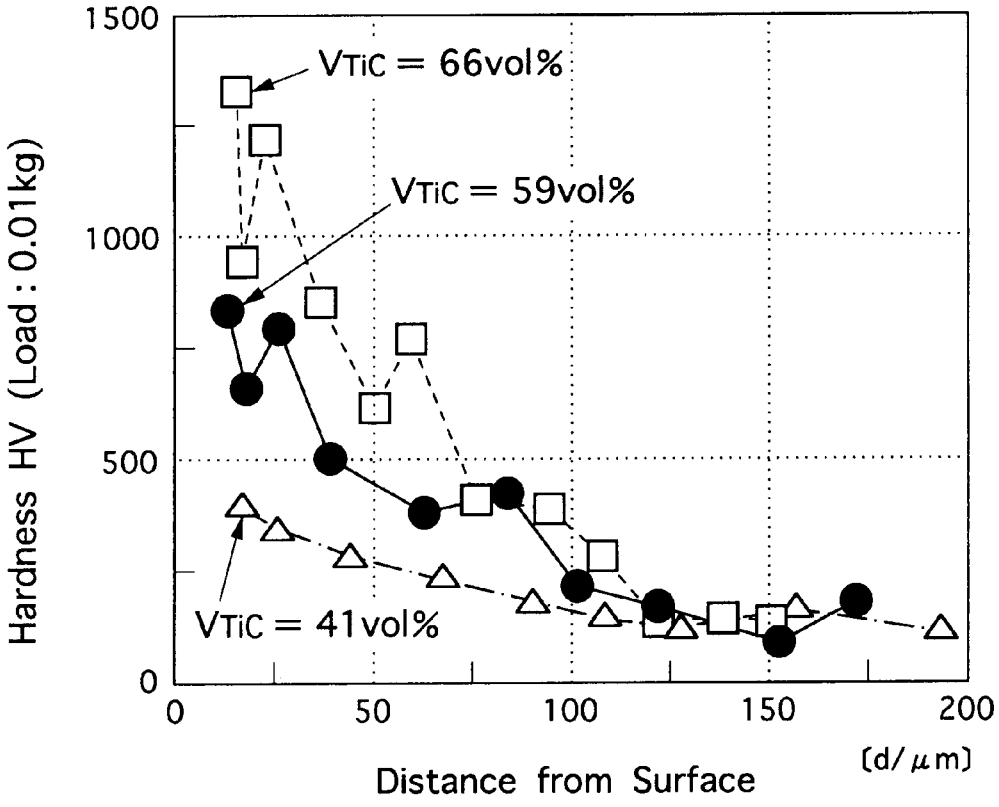
FIG. 9 is a graph showing hardness variation in a cross-section from a surface to an inside of a coating layer of a workpiece which was processed by a surface treatment of the fourth embodiment.
Figure 10A:
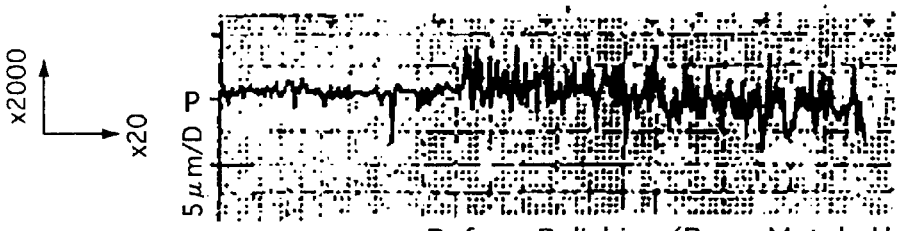
FIG. 10*a* is a drawing showing a cross-section profile of a treated surface of a hard metal workpiece which was processed by an electric discharge a surface treatment of the fourth embodiment but not polished yet.
Figure 10B:
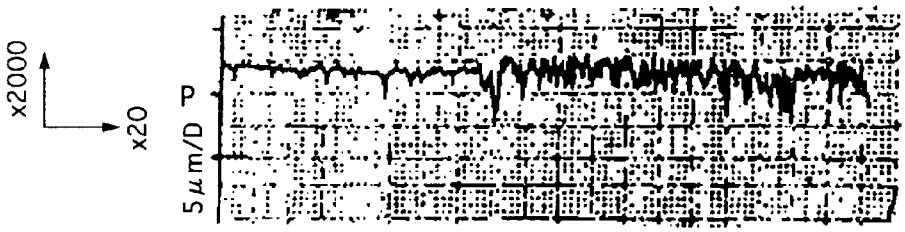
FIG. 10*b* is a drawing showing a cross-section profile of a treated surface of a hard metal workpiece which was processed by an electric discharge a surface treatment of the fourth embodiment and polished.
Figure 10C:
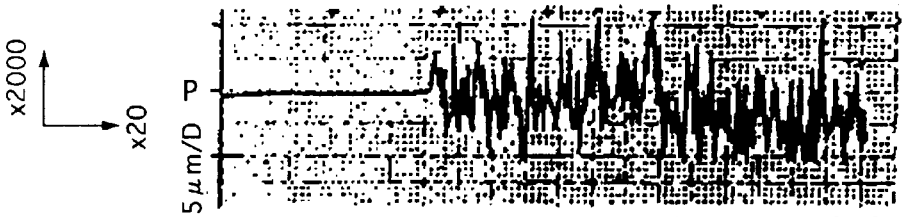
FIG. 10*c* is a drawing showing a cross-section profile of a treated surface of a steel workpiece which was processed by an electric discharge a surface treatment of the fourth embodiment but not polished yet.
Figure 10D:
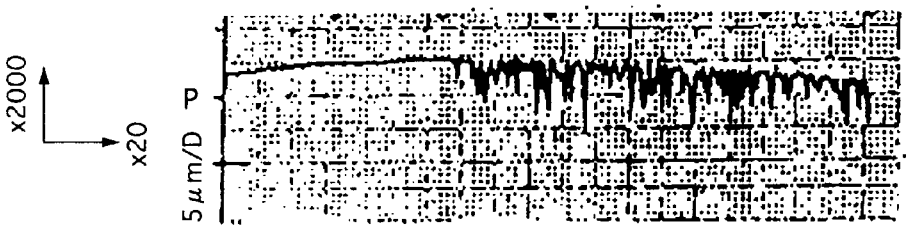
FIG. 10*d* is a drawing showing a cross-section profile of a treated surface of a steel workpiece which was processed by an electric discharge surface treatment of the fourth embodiment and polished.

FIG. 9 shows hardness change in a cross-section from a surface to an inside of a coating layer of an electrically discharged base metal. The electric discharge was performed on the base metal of Vickers hardness of about Hv300, in oil by using Ti green compact electrode. Referring to FIG. 9, Vtic shows a volume ratio of TiC/To on the electrically discharged surface, wherein Ti is bonded with C which is produced from the decomposed oil, thereby to make TiC. The volume ratio can be changed by controlling the discharge current pulse width, discharge time and working fluid or oil supply. The Vickers hardness Hv is measured under a load of 0.01 kg (10 gm).

As described above, the hardness of the base metal surface is high and becomes softer towards the inside. It means that TiC decreases and the proportion of Ti increases toward the inside. Thus, if the base metal surface is polished with a diamond abrasive grains or the like, the surface is smoothed, but the surface hardness is lessened once.

However, if the nitriding treatment is performed on the base metal in that condition, the residual Ti changes into TiN, and TiC changes into TiCN. As a result, the hardness rises again as shown in FIG. 8. As shown in FIG. 7, the nitriding causes substantially no change in the finished surface roughness.

FIGS. 10*a* to 10*d* show cross-section profiles of electrically discharged surfaces of hard metals before and after polishing. The electric discharge was carried out for a short time with a small electric condition (discharge current Ip=7 A, pulse width Ton=2 μs).

In this example in which a thin coating is desired, it is possible that peaks of an irregularity of the treated layer are protruded sufficiently from the base metal, but bottoms thereof are sank inward from the base metal surface. This is because Ti as a component of the green compact electrode brings force a machining action when shot to the base metal surface by the discharge, thereby sinking into the base metal. Thus, the adhesion level becomes very high. This is apparent from the fact that Ti is diffused deeper into the base metal in case of the harder base metal (e.g. hard metal) than the softer base metal (e.g. steel).

Thus, if the mechanical polish is performed to such a degree as not to reach the inside part of the base metal over the electrically discharged surface or coating layer, the coating layer remains existing. In order to prove this fact, the mechanical polishing was carried out nearly up to the original surface of the base metal, and the nitriding was conducted thereafter. As a result, as shown in FIG. 8, the hardness level improves very well.

Next, a description is made on a nitriding surface state after the ED surface treatment. It has the following significant meanings to nitride the EC treated surface.

1) It is well known that a tensile stress remains on the discharged surface because the EDM surface repeats melting and rapid cooling. If the base metal is processed by nitriding after ED treatment, the hardness level rises. At the same time, the volume expands by the intrusion of the nitrogen to reduce the residual tensile stress, and the stress is converted into a compressive side depending on conditions. Thus, the abrasion resistance or the like becomes higher.

2) In case of nitriding the cutting tools or plastic machining dies which were treated by electric discharge with the Ti green compact electrode, the affinity with iron as a workpiece is reduced. Then, the abrasion due to adhesion decreases, thereby increasing the abrasion resistance.

3) As mentioned above, the nitriding does not effect on the surface roughness at all. Thus, it is possible to maintain the machining surface roughness as finished before the nitriding. Namely, the abrasion resistance is improved with a well finished surface remained (Ref. To FIG. 7).

Next, referring to FIG. 11, a description is made on a structure concept of a base metal surface which is polished after ED surface treatment and processed by nitriding thereafter.

If the ED surface coating is not layered thickly enough because of limit of machining time or size or the like, the surface structure is not smooth as a whole. The surface still has some hollows remained as shown in FIG. 11. Such finished surface roughness is not always good if measured. However, in case of requiring a small friction coefficient or high abrasion resistance, such surface can stand a large load. The hollows rather acts as oil grooves for lubricant such as an oil, so that a good result is obtained to the contrary.

An experiment was made about X-ray diffraction measurement and component analysis for the coating layer. The analysis was made by the X-ray diffraction on the surface machined by the TiH2 green compact electrode and polished and nitrided thereafter. Then, it was confirmed that there existed TiCN and TiN.

In the fourth embodiment, the round bar coated with the diamond paste is used as an example to polish the surface of the base metal electrically discharged by TiH2 green compact electrode. However, every means for polishing may be used, as long as it is a mechanical polishing such as manual motion, rotary motion, reciprocating motion, or ultrasonic vibration. Otherwise, it may be a surface grinding simultaneously using an electrochemical action such as an electrolytic grinding.

A fifth embodiment of the invention is described hereafter. One of the objects of this invention relates to a re-coating treatment of the end mill or drill coated with TiN or Ti(AlN). In this case, it is necessary to re-polish the coating by a diamond wheel or the like before the re-coating, thereby to remove abraded portions. An ED treating method which does not require such re-polishing is described hereunder.

FIG. 12 shows a property or condition of a processed surface of a base metal in which an ED surface coating was thickly provided. In case of FIGS. 10*a*–10*d*, the discharge current is Ip=7 A and the discharge pulse width is Ton=2 μs. In case of FIG. 12, the discharge current is Ip=7 A and the discharge pulse width Ton=16 μs. As shown in FIG. 12, the surface coating easily reaches a thickness of about 20 μm or more nearly within ten minutes. Therefore, a normal abraded portion of the tool caused by cutting work can be repaired. Moreover, if the discharge pulse width Ton is longer such as about 32 μs, the coating thickness easily reaches about 100 μm. In this case, the finished surface roughness is large such as nearly 20 μm. Still, the coating is ground by the diamond wheel or the like so as to form a tool edge shape. At the same time, the coating is finished to have a finished surface roughness of about 1 μmRmax which is required for a cutting tool surface. Then, nitriding is performed.

With such ED grinding treatment, the re-coating is possible as far as the cutting tool does not have a great damage, without re-polishing work and size diminution of the cutting tool itself caused by the re-polishing. The tool size diminution due to re-polishing limits the number of times of re-coating.

Figure 13:
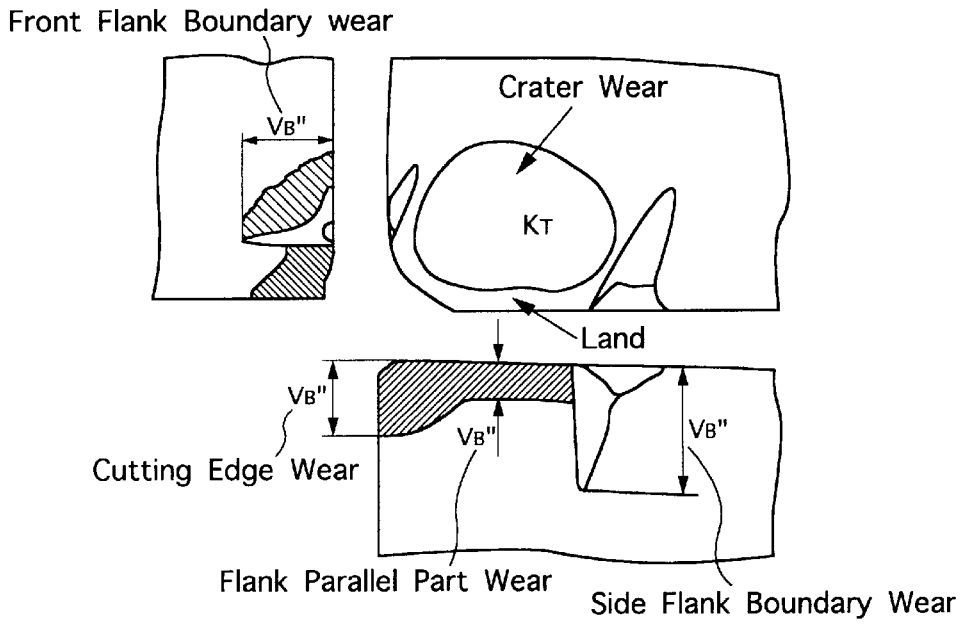
FIG. 13 is an explanatory drawing showing wearing states of a cutting tool which was processed by the surface treatment according to the fifth embodiment of the invention.

FIG. 13 shows various abraded states of the cutting tool. In case of re-polishing, it is necessary to remove even a base part of the tool or base metal in order to cut off abraded portions. Therefore, removed amount in grinding becomes huge. However, if it is repaired so as to embed the coating material therein by ED surface treatment, the removed amount is small and the tool can be used much more times.

As shown in FIG. 13, if the electric discharge is simply performed on a largely abraded cutting tool, such discharge acts only on protruded portions of the surface. Therefore, the coating is piled high only on the protruded portions, so that re-shaping or leveling is sometimes difficult. In this case, the electrode is rotated or oscillated. Then, the coating piled on the protruded portions is removed by the discharge with the electrode coming from the lateral side and hollows therebetween are gradually filled in. If such filling is insufficient, the processed surface including the hollows are coated with green compact component kneaded with an adhesive agent such as araldyte. Then, the electric discharge is performed thereon using the green compact electrode or, if necessary, an electrode of copper, graphite, tungsten-silver or the like which is used in a normal EDM. Consequently, the filling treatment is possible, though the finished surface roughness is not so good. Then, the nitriding treatment is performed thereon.

This method is usable not only in the correction machining for damaged parts of the cutting tools but also in correction machining for metals or bearing parts. Moreover, it is applicable to all the industrial fields.

Next, a description is made on dulling of a cutting edge and its correcting or repairing method.

When the ED surface treatment is done on a sharp part such as a cutting edge of the tool, the cutting edge tends to be easily dulled. This is because the sharp cutting edge has a high potential gradient and the discharge concentrates on such position, if it is machined with an electrode such as the TiH2 green compact electrode. Thus, it is easy to become dull.

To mend the dullness of the cutting edge, the cutting edge is coated with the ED coating thick enough to be covered entirely. Then, the cutting edge and finished surface are machined by a grinding means into a preferred shape for grinding work. Thereafter, the nitriding treatment is performed.

While the nitriding apparatus is shown in FIG. 6, another embodiment is described hereunder.

As in a heating apparatus of a soldering iron, a nichrome wire is coiled. A heated portion of the end mill, drill or the like is put inside the coil. They are disposed in nitrogenous atmosphere and supplied with electricity. Then, the temperature rises easily to around 500 to 600° C. Since the nitriding is performed at about 300° C. or more, such apparatus with coil heater works well.

A laser beam (CO2 laser or YAG laser) is irradiated on a nitriding portion, while supplying nitrogen gas thereto, thereby nitriding it. It works well, too.

Figure 14:
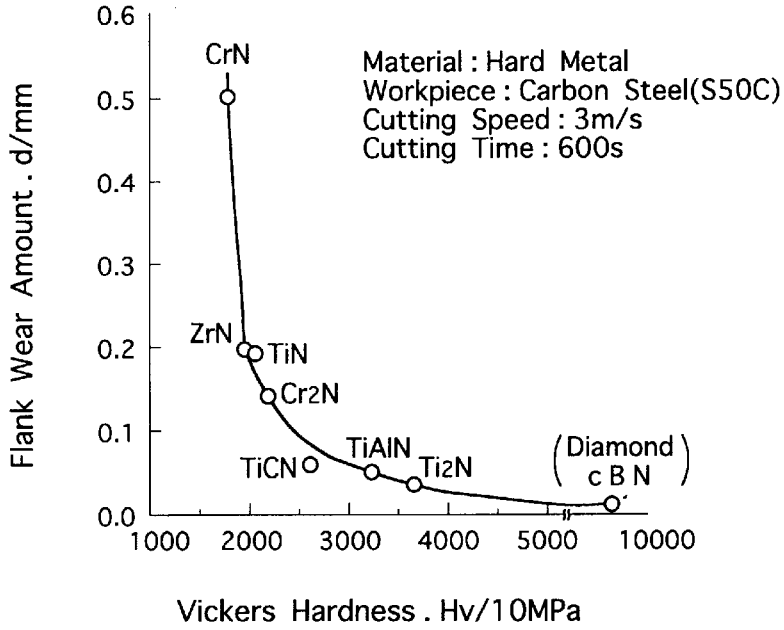
FIG. 14 is a graph showing a relation between a hardness of a coating material and a wear amount in the surface treatment according to the fifth embodiment of the invention.

FIG. 14 shows a relation between a hardness of a coating material and an abrasion amount in a surface treatment of a sixth embodiment of the invention. The sixth embodiment explains generation of Ti2N by adjusting the nitrogen atmosphere. Referring to FIG. 14, it is found that the abrasion loss of the cutting tool is less in case of titanium nitride (Ti2H) than in case of titanium subnitride (TiN). Therefore, mixture of the argon gas and nitrogen gas was used in the nitriding treatment, so as not to reduce the partial pressure of the nitrogen in the air. As a result, generation of Ti2N was confirmed and the abrasion resistance improved. A volume ratio of argon to nitrogen in the air was 70:30 (argon:nitrogen).

The preferred embodiments described herein are therefore illustrative and not restrictive, the scope of the invention being indicated in the appended claims and all variations which come within the means of the claims are intended to be embraced therein.

We claim:

1. An electric discharge surface treating method, comprising the steps of:

forming a coating layer on a surface of a metal workpiece by applying a voltage to generate an electric discharge between the metal workpiece and an electrode; and nitriding the coating layer.

2. A surface treating method according to claim 1, wherein the electrode is made of a material including a raw material of a reforming material.

3. A surface treating method according to claim 2, wherein the electrode is formed of powders including metal hydride powders.

4. A surface treating method according to claim 2, wherein the electrode is made of a metal or a metal compound whose carbide and nitride are both hard materials having a Vickers Hardness of 1000Hv or more.

5. An surface treating method according to claim 2, wherein the coating layer includes at least one of ceramics and a metal.

6. A surface treating method according to claim 5, wherein the nitriding step uses one of a glow discharge, corona discharge, silent discharge, intermittent pulsed arc discharge and high frequency AC arc discharge in a gas or a liquid nitrogen.

7. A surface treating method according to claim 5, wherein the nitriding step is performed by heating the workpiece at 500° C. or more and supplying a nitrogen gas or an ammonia gas on a surface of the coating layer.

8. A surface treating method according to claim 5, wherein the nitriding step is performed by soaking the workpiece in a molten salt generating a nitriding reaction.

9. A surface treating method according to claim 5, wherein the nitriding step is performed by an electrolysis in an aqueous solution of a salt of a cyanide, while using the workpiece as an anode.

10. A surface treating method according to claim 5, wherein the nitriding step is performed by irradiating a laser beam on a surface of the coating layer, while supplying a nitrogen gas to the surface of the coating layer.

11. A surface treating method according to claim 5, further comprising the step of polishing the surface of the coating layer by a grinding stone or abrasive grains of high hardness before the nitriding step.

12. A surface treating method according to one of claims 5, wherein:

the workpiece is a tool having a cutting edge abraded; and the coating layer is formed on the cutting edge so as to be thicker than an abraded portion of the cutting edge;

the surface treating method further comprising the step of shaping the cutting edge formed with the coating layer before the nitriding step.

13. An electric discharge surface treating method, comprising the steps of:

treating a surface of a workpiece by an electric discharge using an electrode made by pressure forming of metal powders which are carbonized to harden, the surface treating being performed in a working fluid decomposed into carbon by the electric discharge;

grinding the surface of the workpiece; and nitriding the workpiece.

14. A surface treating method according to claim 13, wherein the grinding step is performed by mechanically polishing the surface of the workpiece.

15. A surface treating method according to claim 13, wherein the grinding step is performed by an electric discharge.

16. A surface treating method according to claim 13, wherein the electrode is made of the metal powders mixed with at least one of hard carbide, hard nitride and hard boride by pressure forming.

17. A surface treating method according to claim 13, wherein the nitriding step is performed in an atmosphere of a mixture of argon gas and nitrogen.

18. An electric discharge surface treating apparatus comprising:

an electrode;

means for forming a coating layer on a surface of a metal workpiece by applying a voltage to generate an electric discharge between the metal workpiece and the electrode; and means for nitriding the coating layer.

19. A surface treating apparatus according to claim 18, wherein the electrode is made of a material including a raw material of a reforming material and the electric discharge is a pulsed electric discharge.

20. A surface treating apparatus according to claim 18, wherein the coating layer includes at least one of ceramics and a metal and the nitriding means includes a nitriding vessel.

* * * * *

UNITED STATES PATENT AND TRADEMARK OFFICE

CERTIFICATE OF CORRECTION

PATENT NO. : 6,086,684 
DATED : July 11, 2000
INVENTOR(S) : Saito, Nagao, Mouri, Naotake, Tsunekawa, Yoshiki, Shimamoto, Kohei, Goto, Akihiro, Magara, Takuji et al.

It is certified that error appears in the above-identified patent and that said Letters Patent is hereby corrected as shown below:

Column 11,
Line 41, please change "Σ" to -- ε --;
Line 44, please change "ωΣ·v·f" and insert -- ω∝ε·v·f --.

Signed and Sealed this

Ninth Day of October, 2001

*Attest:*

Nicholas P. Godici

*Attesting Officer*

NICHOLAS P. GODICI
*Acting Director of the United States Patent and Trademark Office*